US011794210B2

(12) United States Patent
Garza

(10) Patent No.: US 11,794,210 B2
(45) Date of Patent: Oct. 24, 2023

(54) SIFTER LID DEVICE

(71) Applicant: Raymundo Garza, Sugar Land, TX (US)

(72) Inventor: Raymundo Garza, Sugar Land, TX (US)

(73) Assignee: Raymundo Garza, Sugar Land, TX (US)

( * ) Notice: Subject to any disclaimer, the term of this patent is extended or adjusted under 35 U.S.C. 154(b) by 0 days.

(21) Appl. No.: 17/720,755

(22) Filed: Apr. 14, 2022

(65) Prior Publication Data

US 2022/0339671 A1 Oct. 27, 2022

Related U.S. Application Data

(60) Provisional application No. 63/178,202, filed on Apr. 22, 2021.

(51) Int. Cl.

| | |
|---|---|
| ***B07B 1/02*** | (2006.01) |
| ***B65D 47/06*** | (2006.01) |
| ***B07B 1/46*** | (2006.01) |

(52) U.S. Cl.

CPC ..... *B07B 1/46* (2013.01); *B07B 1/02* (2013.01); *B65D 47/06* (2013.01)

(58) Field of Classification Search

CPC .... B07B 1/46; B07B 1/02; B07B 1/06; B65D 47/06

USPC ..... 209/392

See application file for complete search history.

(56) References Cited

U.S. PATENT DOCUMENTS

| | | | | |
|---|---|---|---|---|
| 971,825 | A * | 10/1910 | Burke | B07B 1/36 209/362 |
| 9,010,540 | B2 * | 4/2015 | Smith | B07B 1/06 209/326 |
| 10,758,941 | B2 * | 9/2020 | Goosen | B07B 1/02 |
| 2015/0305568 | A1 * | 10/2015 | Edri | A47J 43/22 222/189.02 |
| 2021/0362190 | A1 * | 11/2021 | Minissale | A01F 25/14 |
| 2021/0401231 | A1 * | 12/2021 | Li | B07B 1/02 |
| 2022/0214045 | A1 * | 7/2022 | Kumar | A47J 37/0786 |

* cited by examiner

*Primary Examiner* — Michael McCullough
*Assistant Examiner* — Jessica L Burkman
(74) *Attorney, Agent, or Firm* — Conley Rose, P.C.

(57) ABSTRACT

The present invention relates generally to the field of sifters. More specifically, the present invention relates to a sifter lid device. The device is comprised of a body further comprised of a funnel area and a continuous opening in the top surface of the body that receives a sifter insert. The device can be placed on a container such that the contents of the container are sifted through the sifter insert and then can be poured using the funnel area into a secondary location or other container as desired. The sifter insert is further removable and may have a plurality of screen spacings. The device may also be comprised of a lid that covers the sifter insert when the device is not in use but is still attached to a container.

20 Claims, 8 Drawing Sheets

SIFTER LID DEVICE

CROSS-REFERENCE TO RELATED APPLICATION

The present application claims priority to, and the benefit of, U.S. Provisional Application No. 63/178,202 which was filed on Apr. 22, 2021 and is incorporated herein by reference in its entirety.

FIELD OF THE INVENTION

The present invention relates generally to the field of sifters. More specifically, the present invention relates to a sifter lid device. The device is comprised of a body further comprised of a funnel area and a continuous opening in the top surface of the body that receives a sifter insert. The device can be placed on a container, such that the contents of the container are sifted through the sifter insert and then can be poured using the funnel area into a secondary location or other container as desired. The sifter insert is further removable and may have a plurality of screen spacings. The device may also be comprised of a lid that covers the sifter insert when the device is not in use but is still attached to a container. Accordingly, the present disclosure makes specific reference thereto. Nonetheless, it is to be appreciated that aspects of the present invention are also equally applicable to other like applications, devices and methods of manufacture.

BACKGROUND

Many compounds such as paint, flour, dirt, etc. must be sifted to remove undesirable particulates and/or or objects of certain sizes from said compounds. However, in order to sift out particulates and objects from said compounds, a straining device such as a sifter bag, straining bag, straining pan, etc. must be used. Sifting/straining bags specifically are typically only single-use devices, which is inefficient and undesirable. Further, many of said compounds are typically stored within a container. The compound is then typically poured into a straining device and then into a secondary container wherein the compound is then poured back into the original container. This is also undesirable, as the process involves a plurality of unnecessary steps.

Therefore, there exists a long-felt need in the art for a device that allows a user to easily sift a compound. Further, there exists a long-felt need in the art for a device that allows a user to easily sift a compound, wherein the device is reusable. In addition, there exists a long-felt need in the art for a sifter lid device that can be applied to a container, wherein the device allows a compound within the container to be sifted directly from said container and without the need for a secondary container.

The subject matter disclosed and claimed herein, in one embodiment thereof, comprises a sifter lid device. The device is comprised of a body further comprised of a funnel area and a continuous opening in the top surface of the body that receives a sifter insert. The device can be placed on a container, such that the contents of the container are sifted through the sifter insert and then can be poured using the funnel area into a secondary location or other container as desired. The sifter insert is further removable and may have a plurality of screen spacings. The device may also be comprised of a lid that covers the sifter insert when the device is not in use but is still attached to a container.

In this manner, the sifter lid device of the present invention accomplishes all of the forgoing objectives and provides a device that allows a user to easily sift a compound using a reusable device. In addition, the device allows a compound within the container to be sifted directly from said container and without the need for a secondary container. As a result, the sifter lid device overcomes the inefficiencies of other sifting methods known in the art.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a sifter lid device. The device is comprised of a body further comprised of a funnel area and a continuous opening in the top surface of the body that receives a sifter insert. The body is preferably manufactured from a flexible, semi-rigid, or rigid plastic or a durable metal. The body may also be opaque, semi-transparent or transparent. The body may further be comprised of a plurality of indicia such as, but not limited to, patterns, logos, emblems, images, symbols, designs, letters, words, characters, animals, advertisements, brands, etc. In addition, the body may be any color known in the art.

The body is preferably generally circular in shape, but may be any shape and size necessary in order to fit over any shape and size of container known in the art. Said containers may include, but are not limited to, 1 gallon buckets, 5 gallons buckets, etc. that may hold any type of material or compound such as, but not limited to, dirt, rock, soil, food product, paint, chemicals, artificial compounds, natural compounds, etc. To attach the device to a container, the device can be pressed down over a container such that the device contacts the side surfaces of the container and is positioned above the continuous top opening of the container. The top surface of the body of the device is further comprised of at least one generally triangular funnel area that has a pair of raised edges which allow the area to funnel any contents of the container that exits the top opening of the container and passes through the sifter insert into a secondary container or location. As a result, the contents of the container need not be transferred to a secondary container after being sifted from the primary container, as the device allows sifting to occur directly from the primary container while the device is attached to said container.

The inside edge of the continuous opening of the body of the device is further preferably magnetic or covered with a magnetized coating. The inside edge then receives at least one generally circular sifter insert, wherein the outside edge of the insert is preferably magnetic or covered with a magnetized coating. The insert is further comprised of a screen that sifts out undesired particulates or objects. In differing embodiments, the spacing of the screen may be any spacing known in the art that is used in conventional sifter devices or other similar devices of the like. In this regard, the insert can be used in a wide variety of applications that require screens of differing spacings in order to sift out a plurality of different sizes of particulates or objects. In one embodiment, the device is comprised of a kit of multiple sifter inserts, wherein each insert has a differing screen size.

Further, multiple inserts may be stacked atop one another and used simultaneously with the device.

In one embodiment, the device may further be comprised of a lid that attaches to at least one hinge that attaches to the body. The bottom surface of the lid is further comprised of an adhesive or non-adhesive gasket that provides a seal around the opening. In this manner, the lid can be placed and secured in a down position around the opening of the device when a user desires to eliminate the possibility of spillage of the contents of the container that device is attached to.

Accordingly, the sifter lid device of the present invention is particularly advantageous as allows a user to easily sift a compound using a reusable device. In addition, the device allows the compound within the container to be sifted directly from said container and without the need for a secondary container. In this manner, the sifter lid devices overcomes the inefficiencies of other sifting methods known in the art.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
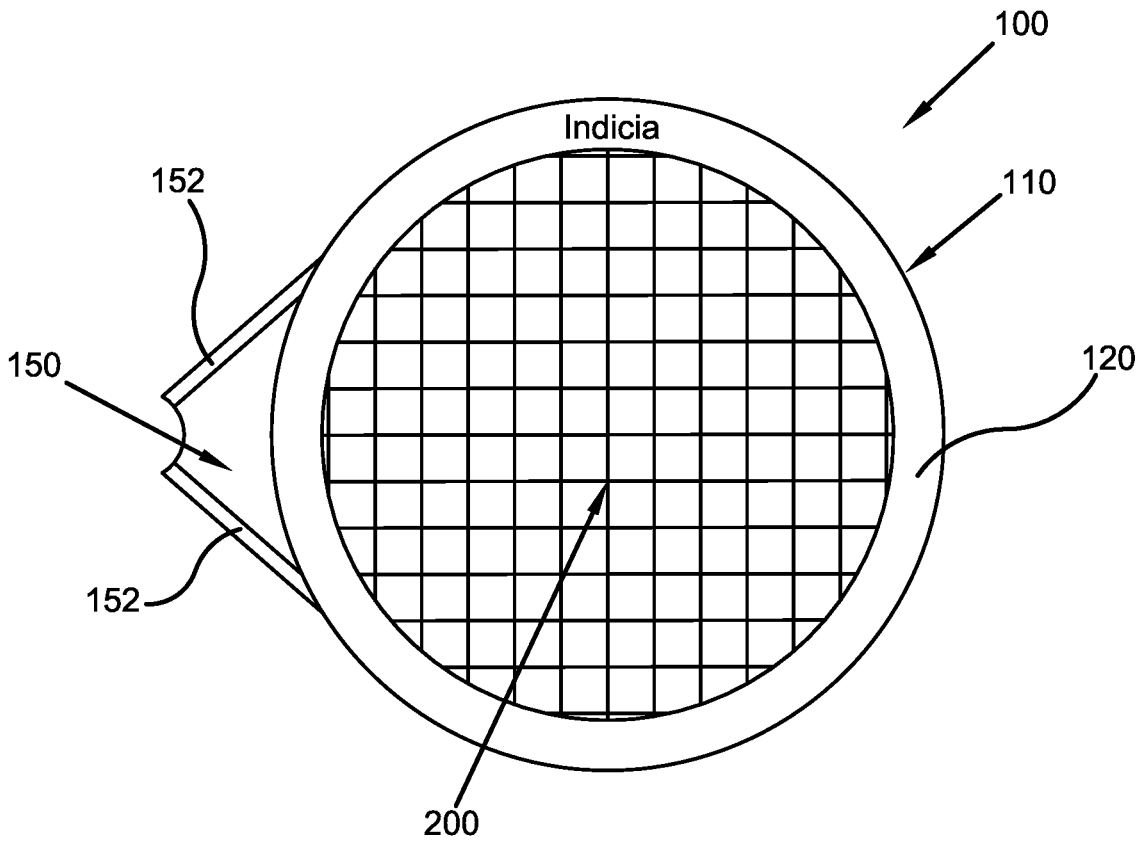
FIG. 1 illustrates a top view of one potential embodiment of a sifter lid device of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for a device that allows a user to easily sift a compound. Further, there exists a long-felt need in the art for a device that allows a user to easily sift a compound, wherein the device is reusable. In addition, there exists a long-felt need in the art for a sifter lid device that can be applied to a container, wherein the device allows the compound within the container to be sifted directly from said container and without the need for a secondary container.

The present invention, in one exemplary embodiment, is comprised of a sifter lid device The subject matter disclosed and claimed herein, in one embodiment thereof, comprises a sifter lid device. The device is comprised of a body further comprised of a funnel area and a continuous opening in the top surface of the body that receives a sifter insert, wherein the body is preferably manufactured from a flexible, semi-rigid, or rigid plastic or a durable metal. The body may also be opaque, semi-transparent or transparent and may further be comprised of a plurality of indicia such as, but not limited to, patterns, logos, emblems, images, symbols, designs, letters, words, characters, animals, advertisements, brands, etc. In addition, the body may be any color known in the art.

The body is preferably generally circular in shape, but may be any shape and size necessary in order to fit over any shape and size of container known in the art. Said containers may include, but are not limited to, 1 gallon buckets, 5 gallons buckets, etc., that may hold any type of material or compound such as, but not limited to, dirt, rock, soil, food product, paint, chemicals, artificial compounds, natural compounds, etc. To attach the device to a container, the device can be pressed down over a container such that the device contacts the side surfaces of the container and is positioned above the continuous top opening of the container. The top surface of the body of the device is further comprised of at least one generally triangular funnel area that has a pair of raised edges which allow the area to funnel any contents from within the container that exits the top opening of the container and passes through the sifter insert into a secondary container or location. As a result, the contents of the container need not be transferred to a secondary container after being sifted from the primary container, as the device allows sifting to occur directly from the primary container while the device is attached to said container.

The inside edge of the continuous opening of the body of the device is further preferably magnetic or covered with a magnetized coating. The inside edge then receives at least one generally circular sifter insert, wherein the outside edge of the insert is preferably magnetic or covered with a magnetized coating. The insert is further comprised of a screen that sifts out undesired particulates or objects, wherein the spacing of the screen may be any spacing known in the art that is used in conventional sifter devices or other similar devices of the like. In this manner, the insert can be used in a wide variety of applications that require screens of differing spacings to sift out a plurality of different sizes of particulates or objects. In one embodiment, the device is comprised of a kit of multiple sifter inserts, wherein each insert has a differing screen size. Further, multiple inserts may be stacked atop one another and used simultaneously with the device.

In another potential embodiment, the device may further be comprised of a lid that attaches to at least one hinge that attaches to the body. The bottom surface of the lid is further comprised of an adhesive or non-adhesive gasket that provides a seal around the opening of the device. In this manner, the lid can be placed and secured in a down position around the opening when a user desires to eliminate the possibility of spillage of the contents of the container that device is attached to.

Accordingly, the sifter lid device of the present invention is particularly advantageous as it allows a user to easily sift a compound using a reusable device. In addition, the device allows the compound within the container to be sifted directly from said container and without the need for a secondary container. In this manner, the sifter lid devices overcomes the efficiencies of other sifting methods known in the art.

Referring initially to the drawings, FIG. 1 illustrates a top view of one potential embodiment of a sifter lid device 100 of the present invention in accordance with the disclosed architecture. The device 100 is comprised of a body 110 further comprised of a continuous opening 122 in the top surface 120 of the body 110 that receives a sifter insert 200 and a funnel area 150. The body 110 is preferably manufactured from a flexible, semi-rigid or rigid plastic such as, but not limited to, an acrylic, polycarbonate, polyethylene, thermoplastic, acrylonitrile butadiene styrene, low density polyethylene, medium density polyethylene, high density polyethylene, polyethylene terephthalate, polyvinyl chloride, polystyrene, polylactic acid, acetal, nylon, fiberglass, recycled plastic, biodegradable plastic, etc. The body 110 may also be manufactured from a durable metal such as, but not limited to, stainless steel or aluminum. In differing embodiments, the body 110 may also be opaque, semi-transparent or transparent. The body 110 may further be comprised of a plurality of indicia 400 such as, but not limited to, patterns, logos, emblems, images, symbols, designs, letters, words, characters, animals, advertisements, brands, etc. In addition, the body 110 may be any color known in the art.

Figure 2A:
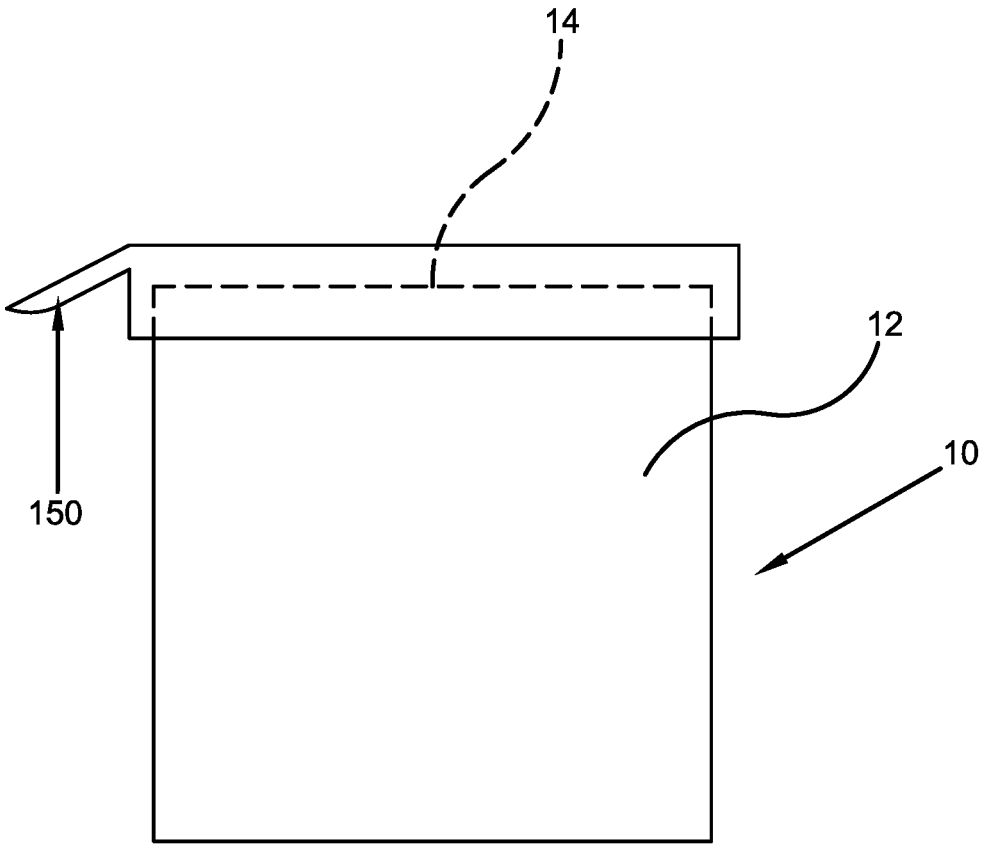
FIG. 2A illustrates a side view of one potential embodiment of a sifter lid device of the present invention while attached to a container in accordance with the disclosed architecture.
Figure 2B:
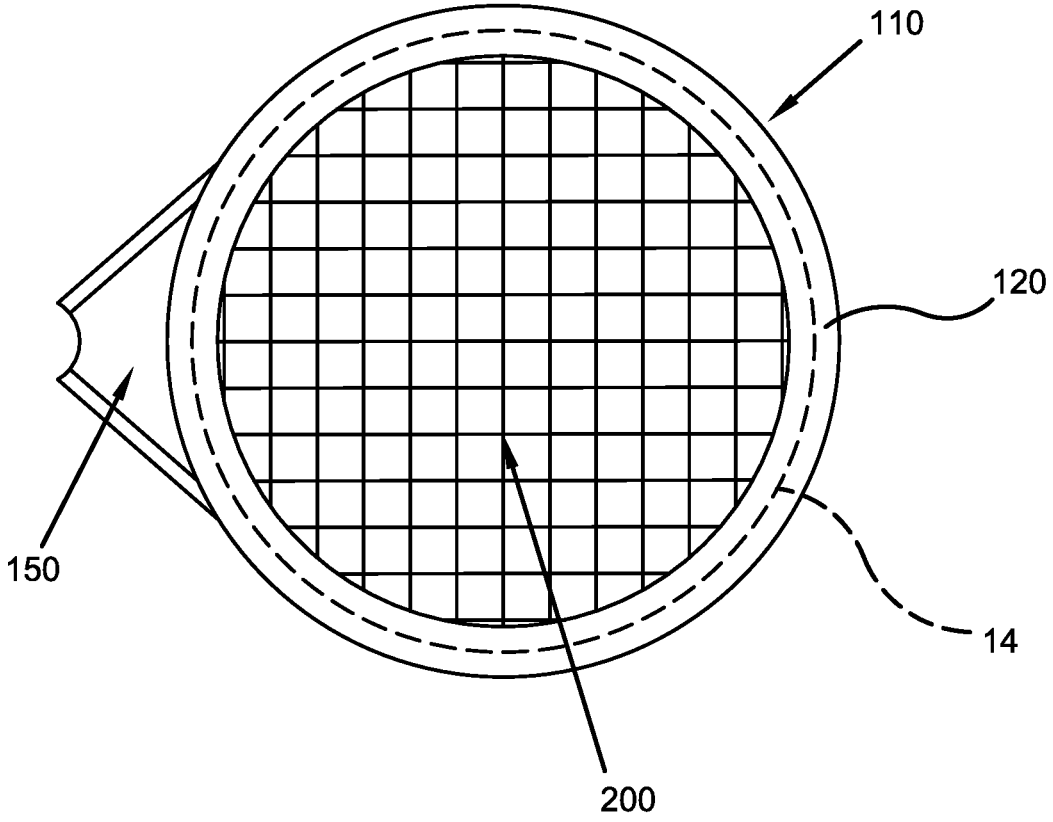
FIG. 2B illustrates a top view of one potential embodiment of a sifter lid device of the present invention while attached to a container in accordance with the disclosed architecture.

The body 110 is preferably generally circular in shape, but may be any shape known in the art in order to fit any shape container 10 known in the art. The body 110 may further be any size (e.g. diameter) in order to fit around any size container 10 known in the art. Said containers 10 may include, but are not limited to, 1 gallon buckets, 5 gallons buckets, etc. that may hold any type of material or compound such as, but not limited to, dirt, rock, soil, food product, paint, chemicals, artificial compounds, natural compounds, etc. As seen in FIG. 2A and FIG. 2B, the device 100 can be pressed down over a container 10 such that the device 100 contacts the side surfaces 12 of the container 10 and is positioned above the continuous top opening 14 of the container 10.

Figure 3:
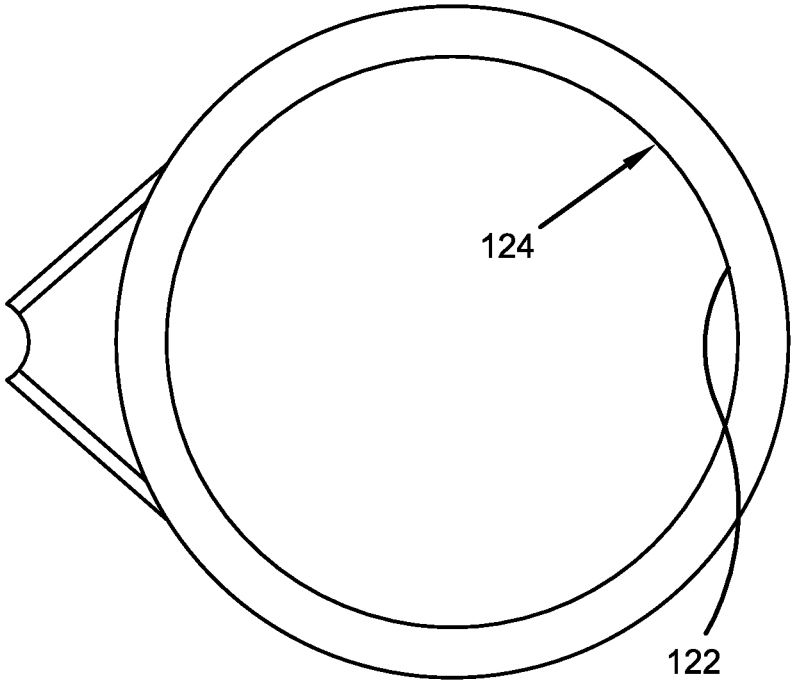
FIG. 3 illustrates a top view of the body of one potential embodiment of a sifter lid device of the present invention in accordance with the disclosed architecture.
Figure 4:
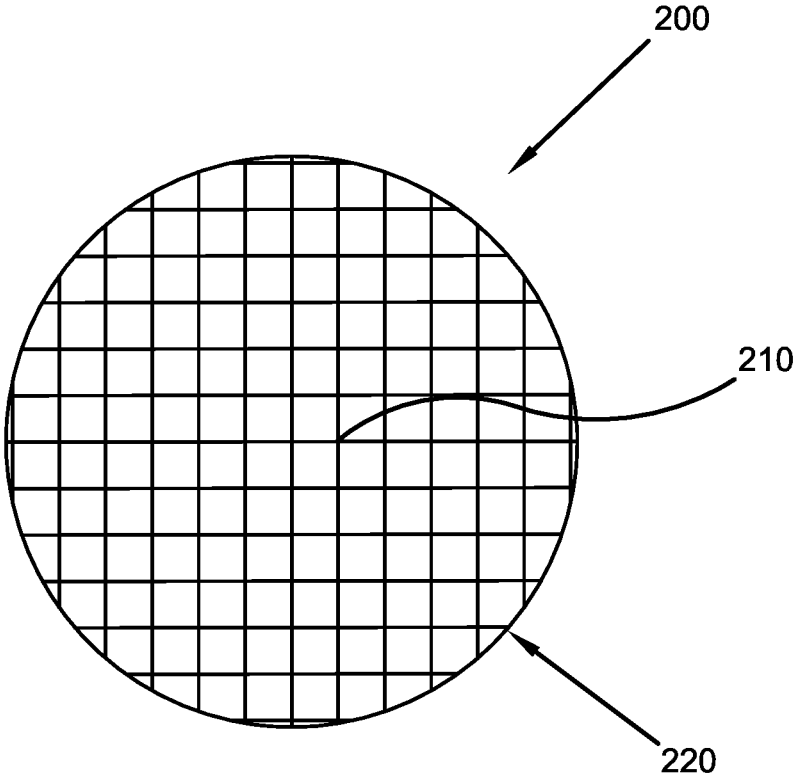
FIG. 4 illustrates a top view of the sifter insert of one potential embodiment of a sifter lid device of the present invention in accordance with the disclosed architecture.
Figure 5:
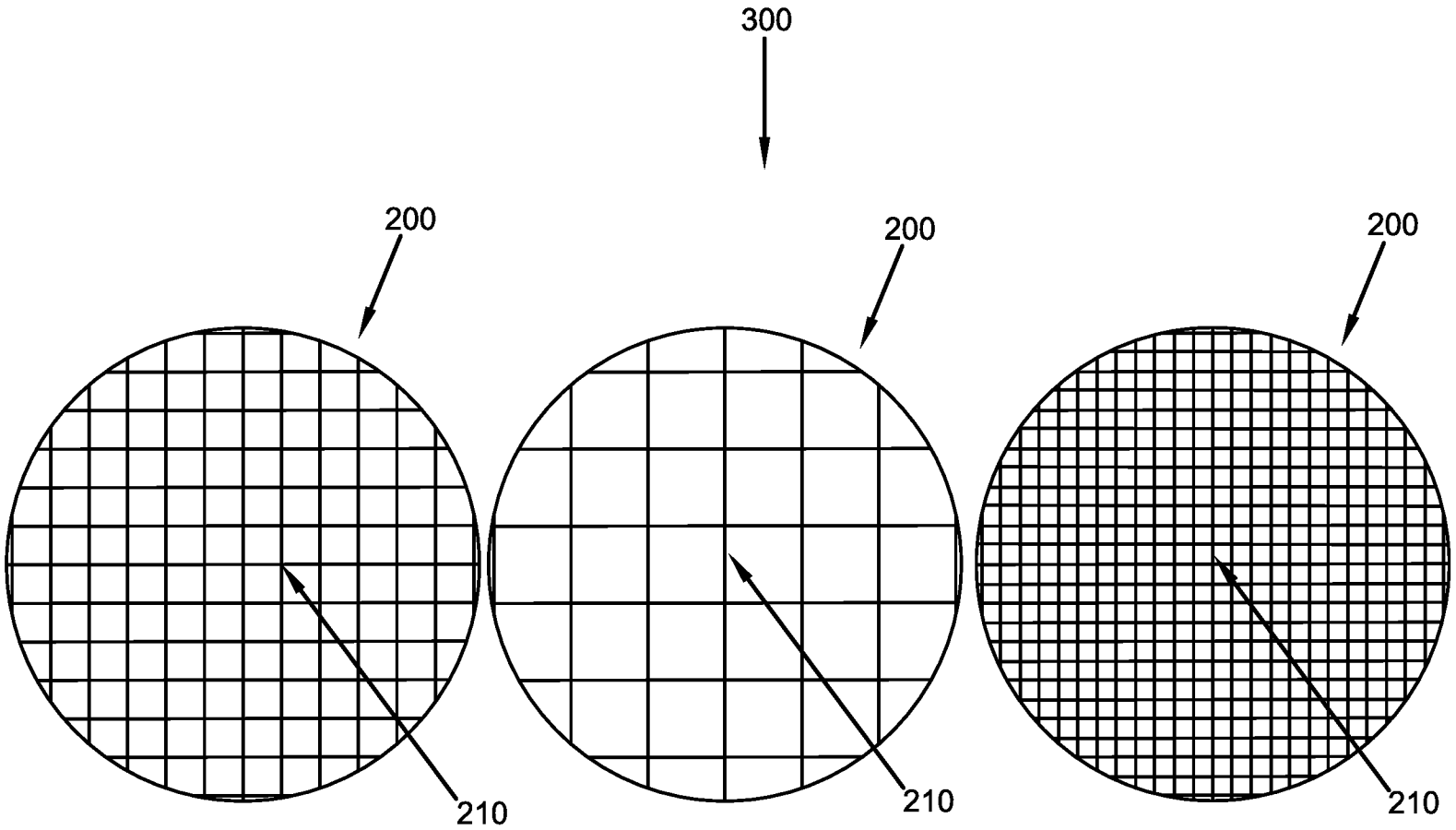
FIG. 5 illustrates a top view of a kit of a plurality of sifter inserts of one potential embodiment of a sifter lid device of the present invention in accordance with the disclosed architecture.

As seen in FIG. 3, the inside edge 124 of the continuous opening 122 of the body 110 is further preferably magnetic or covered with a magnetized coating. The inside edge 124 then receives at least one generally circular sifter insert 200 (seen in FIG. 4), wherein the outside edge 220 of the insert 200 is preferably magnetic or covered with a magnetized coating. The insert 200 is also preferably manufactured from a rigid plastic or metal material that was mentioned supra. The insert 200 may also vary in diameter such that it fits securely within the continuous opening 122 of the top surface 120 in various embodiments of the device 100 wherein the body 110 may be of differing sizes. The insert 200 is further comprised of at least one screen 210 that sifts out undesired particulates or objects. In differing embodiments, the spacing of the screen 210 may be any spacing known in the art that is used in conventional sifter devices or other similar devices of the like. In this regard, the insert 200 can be used in a wide variety of applications that require screens 210 of differing spacings to sift out a plurality of different sizes of particulates or objects. In one embodiment, the device 100 is comprised of a kit 300 of multiple sifter inserts 200, wherein each insert 200 has a differing screen 210 size, as seen in FIG. 5. In one embodiment, multiple inserts 200 may be stacked atop one another and used simultaneously with the device 100.

The top surface 120 is further comprised of at least one generally triangular funnel area 150. The area 150 further has at least one pair of raised edges 152 which allow the area 150 to funnel any contents from within the container 10 that exits the top opening 14 and passes through the sifter insert 200 into a secondary container or location. As a result, the contents of the container 10 need not be transferred to a secondary container after being sifted from the primary container 10, as the device 100 allows sifting to occur directly from the primary container 10 while the device 100 is attached to said container 10. In any embodiment, the shape of the funnel area 150 may be any shape known in the art that is conducive to funneling the contents of the container 10 to a secondary container or location. In addition, the raised edges 152 may extend around the entire top surface 120.

Figure 6:
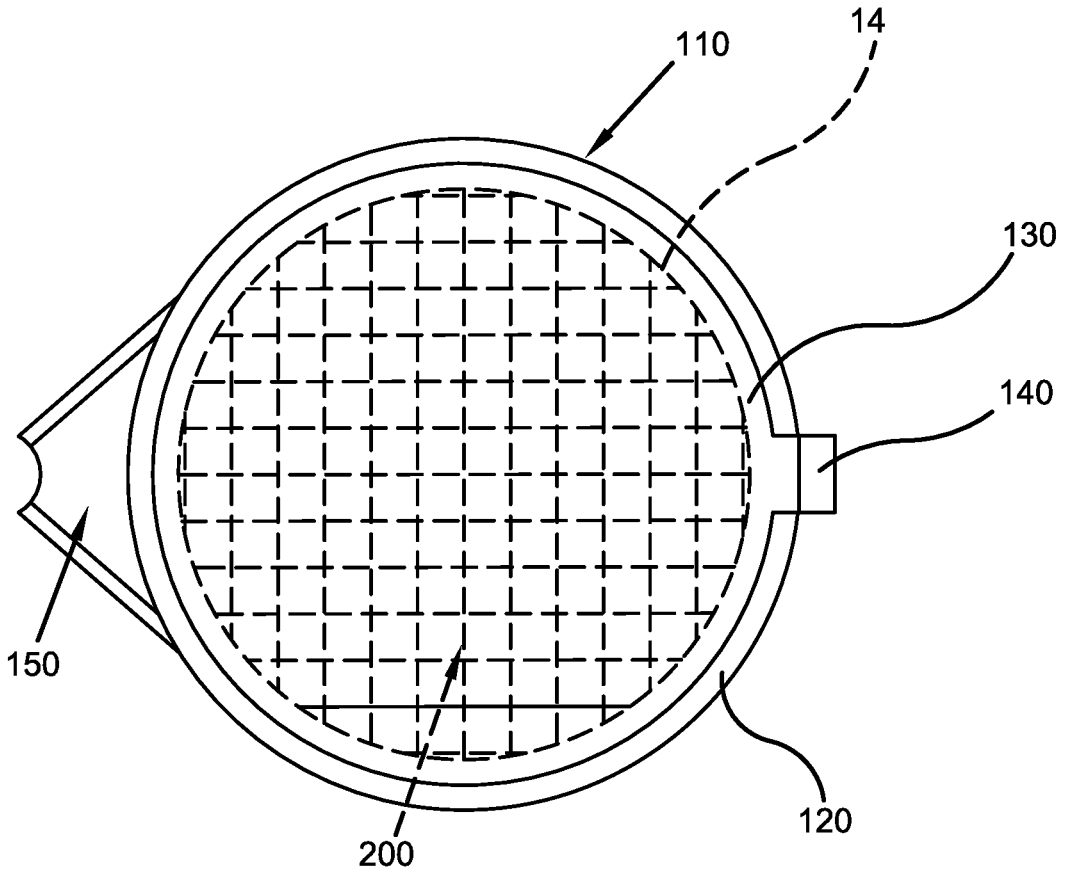
FIG. 6 illustrates a top view of one potential embodiment of a sifter lid device of the present invention in accordance with the disclosed architecture.
Figure 7:
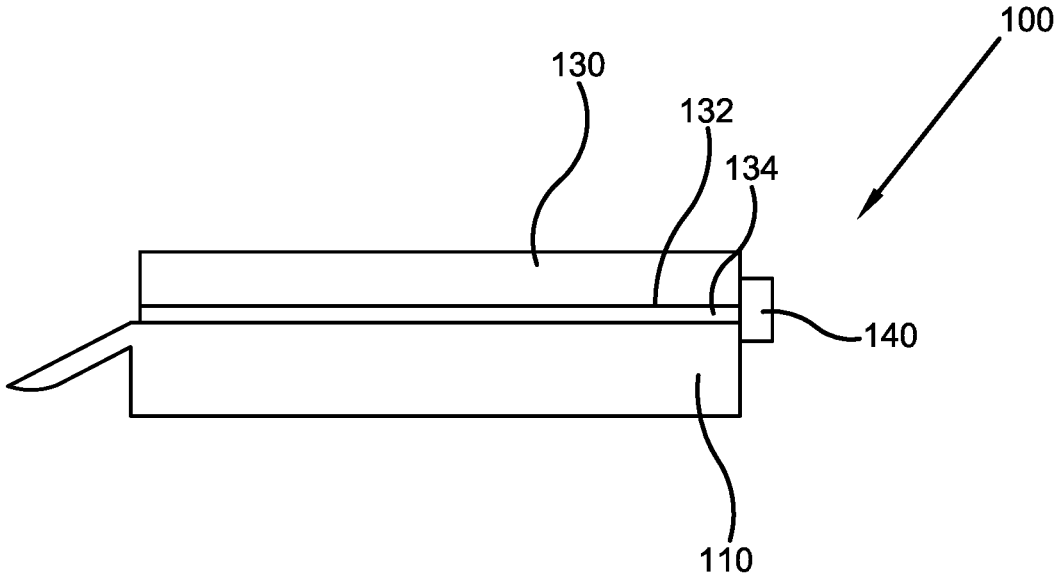
FIG. 7 illustrates a side view of one potential embodiment of a sifter lid device of the present invention in accordance with the disclosed architecture.

FIG. 6 and FIG. 7 illustrate a top and side view of one potential embodiment of a sifter lid device 100 of the present invention in accordance with the disclosed architecture. In one embodiment, the device 100 may further be comprised of a lid 130 that is the same shape as the opening 122 of the top surface 120. The lid 130 attaches to at least one hinge 140 that attaches to the body 110. The bottom surface 132 of the lid 130 is further comprised of an adhesive or non-adhesive gasket 134 that provides a seal around the opening 122. In this manner, the lid 130 can be placed and secured in a down position around the opening 122 when a user desires to eliminate the possibility of spillage of the contents of the container 10 that device 100 is attached to. Further, when a user desires to sift the contents of the container 10, the lid 130 can be flipped upwards and away from the opening 122 to expose the opening 122.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "sifter lid device" and "device" are interchangeable and refer to the sifter lid device 100 of the present invention.

Notwithstanding the forgoing, the sifter lid device 100 of the present invention and its various components can be of any suitable size and configuration as is known in the art without affecting the overall concept of the invention, provided that they accomplish the above-stated objectives. One of ordinary skill in the art will appreciate that the size, configuration and material of the sifter lid device 100 as shown in the FIGS. are for illustrative purposes only, and that many other sizes and shapes of the sifter lid device 100 are well within the scope of the present disclosure. Although the dimensions of the sifter lid device 100 are important design parameters for user convenience, the sifter lid device 100 may be of any size, shape and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A sifter lid device comprising:

a body having a central axis, an exterior top surface with a continuous opening therein defined by an inside edge, and an exterior funnel surface extending radially outwards from the top surface, wherein the funnel surface extends laterally between a first lateral edge and a second lateral edge opposite the first lateral edge whereby the funnel surface is open and exposed to the external environment surrounding the funnel surface, and wherein the funnel surface decreases in lateral width in a radial outwards direction from the central axis; and at least one sifter insert further comprised of at least one screen;

wherein a pouring flowpath is formed along both the top surface and the funnel surface and which extends continuously from the top surface to the funnel surface.

2. The sifter lid device of claim 1, wherein the at least one sifter insert is sized and configured to fit within the continuous opening.

3. The sifter lid device of claim 2, wherein an outside edge of the at least one sifter insert and an inside edge of the continuous opening are magnetic.

4. The sifter lid device of claim 3, wherein the outside edge of the at least one sifter insert is magnetically attached to the inside edge of the continuous opening.

5. A sifter lid device comprising:

a circular body having a central axis, an exterior top surface with a circular continuous opening therein, a magnetic inside edge, and an exterior funnel surface extending continuously from the top surface radially outwards from the central axis, wherein the funnel surface extends laterally between a first lateral edge and a second lateral edge opposite the first lateral edge whereby the funnel surface decreases in lateral width in a radial outwards direction from the central axis, wherein the funnel surface extends continuously from the top surface; and at least one sifter insert removably inserted within the circular continuous opening, the at least one sifter insert comprised of at least one screen and a magnetic outside edge.

6. The sifter lid device of claim 5, wherein the magnetic outside edge of the at least one sifter insert is magnetically attached to an inside edge of the circular continuous opening.

7. The sifter lid device of claim 5, wherein the at least one sifter insert is circular.

8. The sifter lid device of claim 5, wherein the funnel surface is triangular.

9. The sifter lid device of claim 5 further comprising a plurality of sifter inserts.

10. The sifter lid device of claim 9, wherein each of the plurality of sifter inserts comprise a screen with a different screen size.

11. A sifter lid device comprising:

a circular body having a central axis, an exterior top surface with a continuous opening therein, a magnetic inside edge, and an exterior funnel surface extending extends radially outwards from the fop surface and laterally between a first lateral edge and a second lateral edge opposite the first lateral edge whereby the funnel surface IS open and exposed to the external environment surrounding the funnel surface;

at least one sifter insert that is positioned within the continuous opening, wherein the least one sifter insert is comprised of at least one screen and a magnetic outside edge; and a lid having a bottom surface with a gasket, wherein the lid attaches to the circular body via at least one hinge.

12. The sifter lid device of claim 11, wherein the funnel surface is triangular.

13. The sifter lid device of claim 11, wherein a shape and size of the lid corresponds to a shape and size of the continuous opening of the top surface.

14. The sifter lid device of claim 11, wherein the gasket comprises an adhesive.

15. The sifter lid device of claim 14, wherein the gasket is positioned around the continuous opening to form a seal.

16. The sifter lid device of claim 15, wherein the seal is waterproof.

17. The sifter lid device of claim 11, wherein the magnetic outside edge of the at least one sifter insert is removably attached to the magnetic inside edge.

18. The sifter lid device of claim 17, wherein the at least one sifter insert is circular.

19. The sifter lid device of claim 18 further comprising a plurality of sifter inserts.

20. The sifter lid device of claim 19, wherein each of the plurality of sifter inserts have a screen and each of the screens comprise a different screen size.

* * * * *